United States Patent [19]

Satou et al.

[11] 4,314,221

[45] Feb. 2, 1982

[54] INDUCTANCE DEVICE

[75] Inventors: Hiroshi Satou; Tadao Yahagi, both of Tokyo, Japan

[73] Assignee: TDK Electronics Co., Ltd., Tokyo, Japan

[21] Appl. No.: 188,263

[22] Filed: Sep. 17, 1980

[30] Foreign Application Priority Data

Sep. 17, 1979 [JP] Japan ..... 54/128174[U]

[51] Int. Cl.[3] ..... H01F 15/02; H01F 15/10

[52] U.S. Cl. ..... 336/83; 336/192; 336/212

[58] Field of Search ..... 336/83, 96, 212, 192

[56] References Cited

U.S. PATENT DOCUMENTS 2,220,126 11/1940 Six et al. ..... 336/83

3,507,039 4/1970 Craige ..... 336/83 X

*Primary Examiner*—Thomas J. Kozma

*Attorney, Agent, or Firm*—Oblon, Fisher, Spivak, McClelland & Maier

[57] ABSTRACT

An inductance device comprises a drum core on which a coil is wound and which has a projection; a rectangular pot core having each concave part on the upper surface and the lower surface and having a hollow for fitting said drum core and a hole for fitting said projection of said drum core; electrode parts which are respectively formed on each side surface and said concave part of the upper surface of said pot core and on the bottom surface of said pot core; said drum core having said coil being fitted into said hollow of said pot core; and said coil being connected to said electrode parts at said concave part by each of lead terminals of said coil; and said drum core being sealed in said hollow.

4 Claims, 7 Drawing Figures

FIG. 1
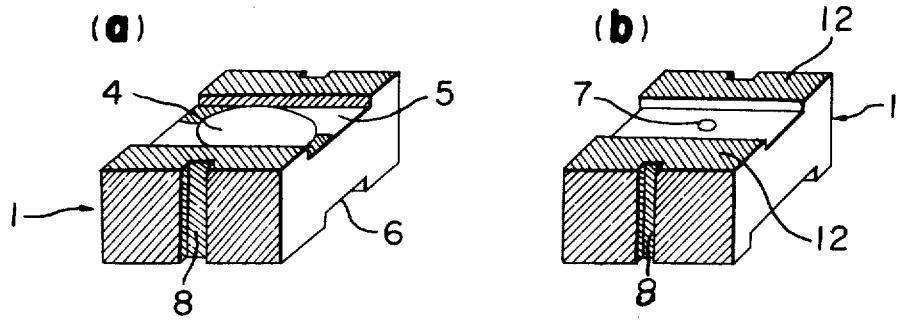
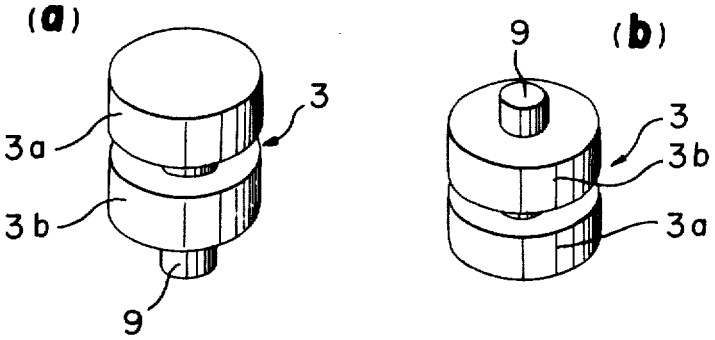
FIG. 2
FIG. 3
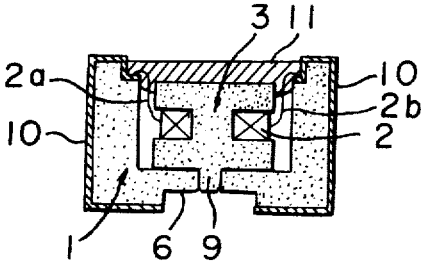
FIG. 4
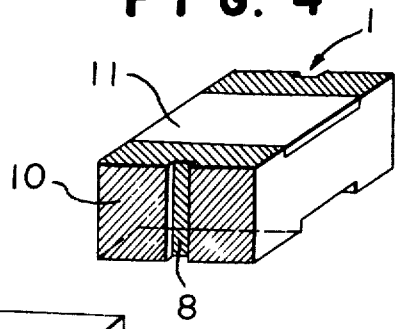
FIG. 5
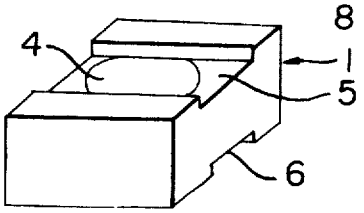

INDUCTANCE DEVICE

BACKGROUND OF THE INVENTION

1. Field of the Invention

The present invention relates to a inductance device used for communication instruments and apparatuses. More particularly, it relates to a magnetic shield type compact inductance device in which a drum core having a coil is held in a rectangular pot core.

2. Description of the Prior Arts

The conventional compact inductance devices have parts having complicated structures whereby the processability for preparing such inductance device has been low. Moreover, it has been difficult to obtain stable characteristics of the inductance devices and to cause magnetic fault in view of a mass production of non-uniform products of the inductance devices.

SUMMARY OF THE INVENTION

It is an object of the present invention to provide an inductance device which has stable characteristics without causing magnetic fault.

It is another object of the present invention to provide an inductance device whose electrode is not easily peeled off to cause disconnection.

The present invention is to overcome the above-mentioned disadvantage and to provide a compact inductance device as a combination of a rectangular pot core and a drum core having a projection for positioning the drum core in the pot core.

The foregoing and other objects of the present invention have been attained by providing an inductance device which comprises a drum core on which a coil is wound and which has a projection; a rectangular pot core having each concave part on the upper surface and the lower surface and having a hollow for fitting said drum core and a hole for fitting said projection of said drum core; electrode parts which are respectively formed on each side surface and said concave part of the upper surface of said pot core and on the bottom surface of said pot core; said drum core having said coil being fitted into said hollow of said pot core; and said coil being connected to said electrode parts at said concave part by each of lead terminals of said coil and said drum core being sealed in said hollow.

BRIEF DESCRIPTION OF THE DRAWINGS

FIGS. 1(A) and (B) are respectively a schematic view of an upper surface and a schematic view of a lower surface of a pot core used in the present invention;

FIGS. 2(A) and (B) are respectively a schematic view of an upper surface and a schematic view of a lower surface of a drum core used in the present invention;

FIG. 3 is a sectional view of the inductance device of the present invention;

FIG. 4 is a schematic view of the inductance device of FIG. 3; and

FIG. 5 is a schematic view of an upper surface of the other embodiment of a pot core used in the present invention.

DETAILED DESCRIPTION OF THE PREFERRED EMBODIMENTS

Referring to the drawings, the embodiments of the present invention will be illustrated. In the drawings, the reference numeral (1) designates a rectangular pot core which has a hollow (4) for fitting a drum core (3) on which a coil (2) is wound. A concave part (5) being larger than the diameter of the hollow (4) is formed on the surface of the pot core having the hollow (4) and a hole (7) for positioning the drum core (3) and a concave part (6) are formed on the bottom surface of the pot core. Each groove (8) is formed on both side surfaces of the pot core (1) at substantially central line part.

The drum core (3) has flanges (3*a*), (3*b*) at both sides of the central part for winding the coil (2). A projection (9) for fitting to the hole (7) for positioning of the pot core (1) is formed on one side of the flange (3*b*).

When the drum core (3) on which the coil (2) is wound is fitted to the pot core (1) having said structure to form the inductance device shown in FIG. 3, the desired windings are wound between the flanges (3*a*), (3*b*) of the drum core (3) to form the coil (2). Then, each electrode part (10) is formed on both side surfaces having the grooves (8) on the pot core (1). The electrode parts (10) are respectively elongated to the concave part (5) formed on the upper surface having the hollow (4) of the pot core and also to the convex part (12) formed on the bottom surface of the pot core.

The electrode parts (10) formed on the concave part (5) are formed separately in substantially symmetric positions for right and left parts at the hollow (4) as shown in FIG. 1(A) but are not formed on all of the concave surface, so that the electrode parts (10) on both side surfaces are not connected each other.

The electrode parts (10) can be formed by coating a electric conductive layer, or plating a metal or bonding an electrode plate on the surfaces. The electrode parts (10) are also formed on the inner surfaces of the grooves (8).

The projection (9) of the drum core (3) on which the coil (2) is wound is fitted with a binder etc. to the hole (7) on the pot core (1) for positioning the drum core (3). Lead terminals (2*a*), (2*b*) of the coil (2) are respectively soldered on both sides of the upper concave part (5). Then, the upper concave part (5) of the pot core (1) is sealed with a sealing composition (1) such as a heat resistant resin so as to form the inductance device.

As described above, the inductance device of the present invention has rectangular configuration which is easily used and has a magnetic shield structure having substantially closed magnetic path. Therefore, even though it is a compact size, a production of products having non-uniform structure can be prevented to obtain constant stable characteristics, whereby no magnetic fault for uses in circuits is found.

The electrode parts are formed on both side surfaces and the upper and lower surfaces of the pot core of the inductance device having a rectangular structure, whereby it is easily equipped with or assembled to instruments and devices and the processability for the assembling are remarkably improved. When the inductance device is arranged and connected on a circuit such as a substrate of a circuit, in the case of relatively low height of the sealing composition (11) for sealing the concave part on the upper surface of the pot core (1), the inductance device can be connected at the desired side of the upper surface or the lower surface of the pot core because the electrode parts are formed on both the upper and lower surfaces of the pot core. Therefore, the equipment and assembling of the inductance device can be easily carried out.

Each groove is formed on both side surfaces on which the electrode parts are respectively formed.

Even though the electrode surface is rubbed, any disconnection is not caused because of the connection to the electrode parts in the grooves. The practical effect is remarkably high.

In the above-mentioned embodiment, the embodiment having the grooves at substantially center lines on both side surfaces of the pot core. The groove, however, is not always necessary to form on the side surface. When the electrode part is formed on a side surface on which any mechanical peeling-off is not caused, it is unnecessary to form any groove.

The hollow (4) is usually cylindrical, however, it can be deformed depending upon the configuration of the drum core (3). The size of the hollow (4) is slightly larger than the outer size of the drum core (3) with the recess for the sealing composition.

We claim:

1. An inductance device which comprises a drum core on which a coil is wound and which has a projection; a rectangular pot core having each concave part on the upper surface and the lower surface and having a hollow for fitting said drum core and a hole for fitting said projection of said drum core; electrode parts which are respectively formed on each side surface and said concave part of the upper surface of said pot core and on the bottom surface of said pot core; said drum core having said coil being fitted into said hollow of said pot core; and said coil being connected to said electrode parts at said concave part by each of lead terminals of said coil; and said drum core being sealed in said hollow.

2. The inductance device according to claim 1 wherein said drum core has flanges at both ends and said coil is wound between said flanges.

3. The inductance device according to claim 1 wherein said electrode parts are formed on the concave part of the upper surface of said pot core in symmetric positions without connection.

4. The inductance device according to claim 1 wherein each groove is formed on each side surface on which said electrode is formed.

* * * * *